United States Patent [19]

Davis

[11] Patent Number: 4,475,453

[45] Date of Patent: Oct. 9, 1984

[54] LIQUID-SOLID SEPARATION UTILIZING PRESSURE ROLLS COVERED WITH ELASTOMERIC LAYERS

[75] Inventor: Steven Davis, Farmington, Utah

[73] Assignee: Envirotech Corporation, Salt Lake City, Utah

[21] Appl. No.: 341,728

[22] Filed: Jan. 26, 1982

Related U.S. Application Data

[63] Continuation-in-part of Ser. No. 234,610, Feb. 17, 1981, abandoned.

[51] Int. Cl.[3] ..... B30B 5/04

[52] U.S. Cl. ..... 100/118; 100/37; 100/121; 100/153; 100/90; 210/400; 210/783

[58] Field of Search ..... 100/35, 37, 118, 119, 100/120, 121, 151, 152, 153, 154, 90; 210/783, 400, 401, 386, 387, 491, 508

[56] References Cited

U.S. PATENT DOCUMENTS

| | | | |
|---|---|---|---|
| 2,027,657 | 1/1936 | Roggen et al. . | |
| 2,711,130 | 6/1955 | Gueitler . | |
| 2,846,944 | 8/1958 | Wilmes et al. . | |
| 2,966,112 | 12/1960 | Guettler | 100/153 X |
| 3,315,370 | 4/1967 | Hikosaka . | |
| 3,613,564 | 10/1971 | Wheeling | 100/118 |
| 3,699,881 | 10/1972 | Levin et al. . | |
| 3,703,963 | 11/1972 | Eguchi et al. . | |
| 3,804,707 | 4/1974 | Mohr et al. . | |
| 3,896,030 | 7/1975 | Bähr . | |
| 3,897,341 | 7/1975 | Ozawa | 210/386 |
| 3,915,865 | 10/1975 | Haji et al. . | |
| 3,951,805 | 4/1976 | Dodd . | |
| 4,019,431 | 4/1977 | Bastgen . | |
| 4,053,419 | 10/1977 | Pav | 100/120 X |
| 4,062,779 | 12/1977 | Nakamura et al. . | |
| 4,266,474 | 5/1981 | Bähr . | |
| 4,358,381 | 11/1982 | Takeuchi et al. | 100/118 |

OTHER PUBLICATIONS

Komline-Sanderson Bulletin: KSB 151-7709, 1977.

William R. Perrin Co., Publication, "Sludge Dewatering by Continuous Filter Belt Press", Nov. 1977.

*Primary Examiner*—Peter Feldman

*Attorney, Agent, or Firm*—Robert E. Krebs

[57] ABSTRACT

A method and apparatuses for expressing the liquid phase from a wet mixture such as a clay-like mixture includes a primary roll (12, 104) with a plurality of smaller pressure rolls (13, 112–118) biased against its surface at circumferentially spaced intervals and at increasing pressures. The primary roll and at least the upstream one (112) of the pressure rolls have a thick outer covering of a substantially deformable elastomeric material. A pair of opposed filter belts (22, 23 or 142, 144) are trained about the primary roll and means are provided to feed the wet mixture between the belts to carry the mixture successively through the nips between the primary roll and the pressure rolls. The mixture is initially subjected in the first nip to a relatively gradual rate of increase in pressure and in subsequent nips is subjected to progressively steeper rates of increase in pressure adapted to the different flow behavior of the mixture caused by the increasing solids content of the mixture. In one embodiment all of the pressure rolls (112–118) are covered with equally thick elastomeric layers of equal hardness, and the first roll (112) is biased with a predetermined relatively low pressure to initially subject the wet mixture to said relatively gradual increase in pressure. In an alternative embodiment intended for wetter mixtures, the rolls (112'–118') are covered with equally thick layers which increase in hardness in the direction of travel of the belts. Specially fabricated belts and edge seals are disclosed.

63 Claims, 22 Drawing Figures

LIQUID-SOLID SEPARATION UTILIZING PRESSURE ROLLS COVERED WITH ELASTOMERIC LAYERS

BACKGROUND OF THE INVENTION

This invention generally relates to the separation of the liquid phase from a mixture of liquids and solids, hereafter called a wet mixture. More particularly, this invention concerns an improved method and apparatus for expressing the liquid phase from a wet mixture that utilizes rolls biased against each other to yield a relatively dry mixture, hereinafter referred to as cake.

There are at present several methods by which the liquid and solid fractions or phases of a wet mixture can be separated to yield a cake. These include vacuum filtration, pressure filtration, centrifugation and compression in, for example, the so-called belt presses. Any of these methods will yield a cake that, although appearing dry, may still contain more than fifty percent moisture by weight. In situations where the cake must be further dewatered, removal of further liquid phase is typically carried out by heating, which of course significantly adds to the overall operating expense, especially in view of the current high energy costs. For these reasons, it is apparent an improved apparatus that would mechanically remove sufficient liquid phase from the wet mixture to avoid such additional steps would be desirable, not only from the viewpoint of managing the costs of the liquid-solid separation, but also from the broader perspective of conserving scarce energy resources.

SUMMARY OF THE INVENTION

An important object of the present invention is to provide an improved apparatus for expressing the liquid phase from a wet mixture, such as a slurry or a sludge, that is capable of directly accepting and expressing the majority of the liquid phase from a wide variety of wet mixtures including, for example, even those mixtures that exhibit gel-like or clay-like flow behaviors.

It is a further object of this invention to provide an improved apparatus for expressing additional liquid from moist cake that is yielded from prior separation equipment.

A related object is to provide an apparatus embodying this invention for accepting a dilute slurry and, by successive steps, removing liquid therefrom to eventually yield a cake of a mositure content that is significantly lower than that attainable by usual liquid-solids separation equipment adapted to dewater slurries.

The foregoing objects of the invention are achieved by a method and apparatus for expressing the liquid phase from a wet mixture comprising at least one, but preferably a pair of filter belts that are entrained about a primary roll which rotates to circulate the belts successively through a plurality of pressure zones created by a plurality of pressure rolls. The pressure rolls are biased with predetermined forces toward the primary roll to thereby squeeze the mixture between the belts as successively higher pressures that increase in the direction of belt travel. The primary roll has a deformable elastomeric layer thereon, as does at least the upstream pressure roll so that within the extended nip between the primary roll and the deformable upstream roll, the wet mixture is subjected to a predetermined relatively gradual pressure increase immediately as it enters such nip.

The biasing pressure upon the upstream roll is adjusted in accordance with the deformability of its elastomeric layer so that the wet mixture carried on the belts, is accepted in the nip, rather than being rejected from the rolls. In this connection, it is well-known by those of skill in the liquid-solid separation art that if the nip between conventional hard nip rolls is too abrupt, that is, if the nip angle is too large, and also if biasing pressure on the nip rolls is relatively high, wet mixture will not enter the nip and pass between rolls, but instead will simply accumulate ahead of the rolls and eventually be rejected laterally upstream of the nip. The present invention solves this longstanding problem in the liquid-solid separation art by covering at least the upstream pressure roll of the expressing apparatus with the aforementioned deformable elastomeric layer that subjects the wet mixture to a predetermined relatively gradual increase in pressure immediately as the mixture enters the first nip.

In one preferred embodiment, the primary roll and pressure rolls have elastomeric coverings that have identical deformabilities. In another embodiment, the pressure rolls have different elastomeric layers formed thereon, and the layers increase in firmness in the direction of travel of the belt. In both embodiments, the rate of increase in pressure exerted on the mixture is relatively gradual in the upstream nips and the rate of pressure increase becomes steeper in each successive nip, thus taking into account the increase in solids content of the mixture as it exits each nip and arrives for further expression of liquid phase in the following nip.

According to the present invention, a peak pressure from a low of about ten psi to as high as 1000 psi can be developed in the extended nip pressure zone between the elastomer-covered rolls. Between the pressure zones, the pressure exerted on the mixture is limited to that which may be imposed by the belt tension. In a single belt system the mixtures are carried through the pressure zones between the belt and the elastomeric layer on the primary roll, while in a two belt system the mixture is carried between the two belts, both of which are trained about the primary roll, or equivalent thereof, to pass between it and the several pressure rolls.

In a preferred embodiment, two belts are used and each is comprised of multiple plies, including a ply of filter cloth adjacent the mixture and a decking ply adapted to contact the elastomeric layers of the rolls and to act as decking for absorbing free liquid, thus reducing rewetting of the mixture as it is carried out of the respective pressure zones.

Some mixtures, after being dewatered, tend to cling quite tenaciously to the carrying belt. In accordance with a preferred embodiment of the invention, any potential problem resulting from such characteristic is overcome by applying a disrupting shear force to the cake adjacent the upper belt, or the primary roll when only a single belt is used; this shear force is applied as the belt or belts pass through the final nip. Generation of this shear force may be accomplished by altering the shape of the final pressure zone and thus the configuration of the path traversed by the belts. This is done in one preferred embodiment by not covering the final pressure roll with any elastomeric layer or by covering it with a much firmer elastomeric layer relative to the coacting elastomeric layer on the primary roll. In one example, the elastomeric layers on the primary roll and the downstream pressure roll are of equal thickness, but the latter is harder than the former.

In connection with feeding the wet mixture to the expressing apparatus of the present invention, when two filter belts are employed, at least the outer or lower belt may be guided through a feed section upstream of the pressure rolls, and the belts are guided to converge as they approach the primary roll to thereby capture the wet mixture supplied to the lower belt. In the preferred embodiments, straps are provided at the side margins of the belt for pinching the side margins of the two belts against each other to prevent extrusion of mixture. The straps may be sewn to the belts at their margins. On another embodiment, separate loose straps are entrained to circulate over the primary roll with the belts and are tensioned to pinch the margins of the belts against the primary roll in a zone that is upstream of the first nip. The straps cooperate to retain mixture between the belts in this zone upstream of the first nip so that the wet mixture is distributed by pressure exerted by the tensioned belts generally across the width of the belts, with the straps preventing escape of the mixture from the margins, both within this zone and subsequently within the nips. In yet another embodiment, elastomeric straps are bonded to the side margins of the primary roll to, in effect, form wide ribs on the primary roll that register with the side margins of the belts. The elastomeric straps are thicker than the mixture as spread between the belts upstream of the first nip. The elastomeric straps, being thicker than the mixture, squeeze the margins of the belts with a higher pressure than elsewhere on the belts.

DESCRIPTION OF THE PREFERRED EMBODIMENTS

Figure 1:
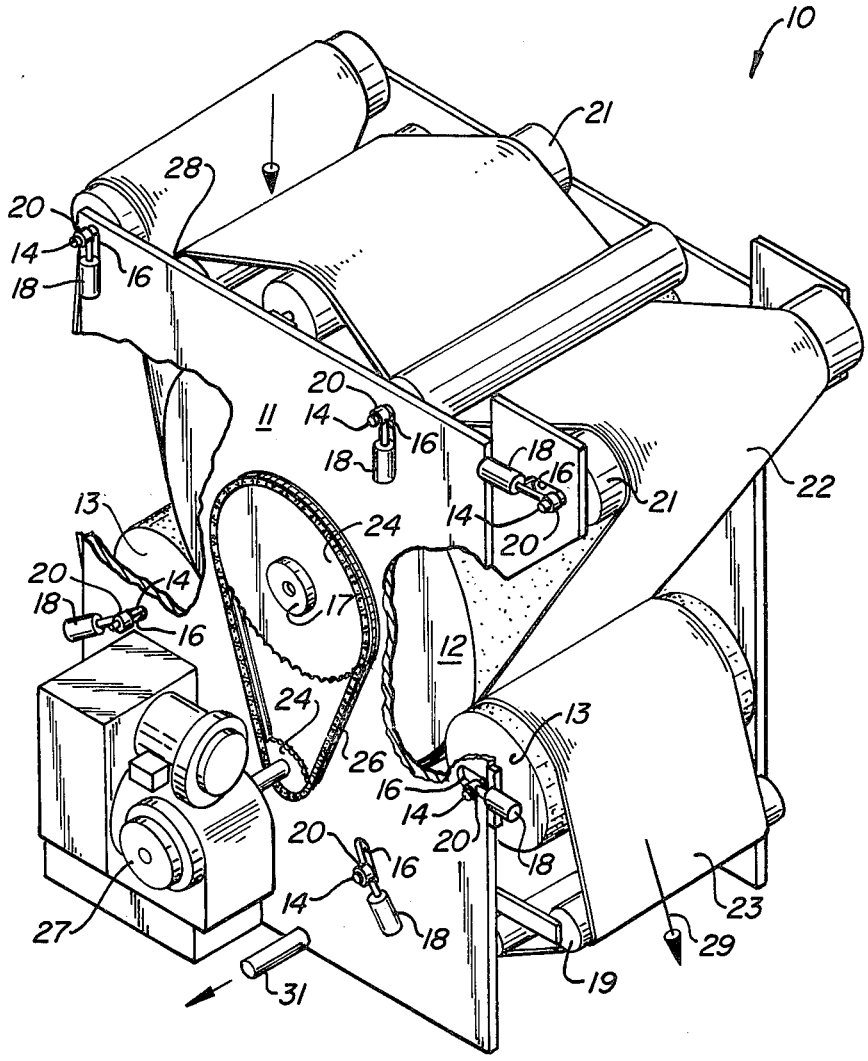
FIG. 1 is a somewhat diagrammatic isometric view of a first preferred embodiment of the expressing apparatus of the present invention, with parts thereof being broken away to show the elastomer-covered primary and pressure rolls.
Figure 2:
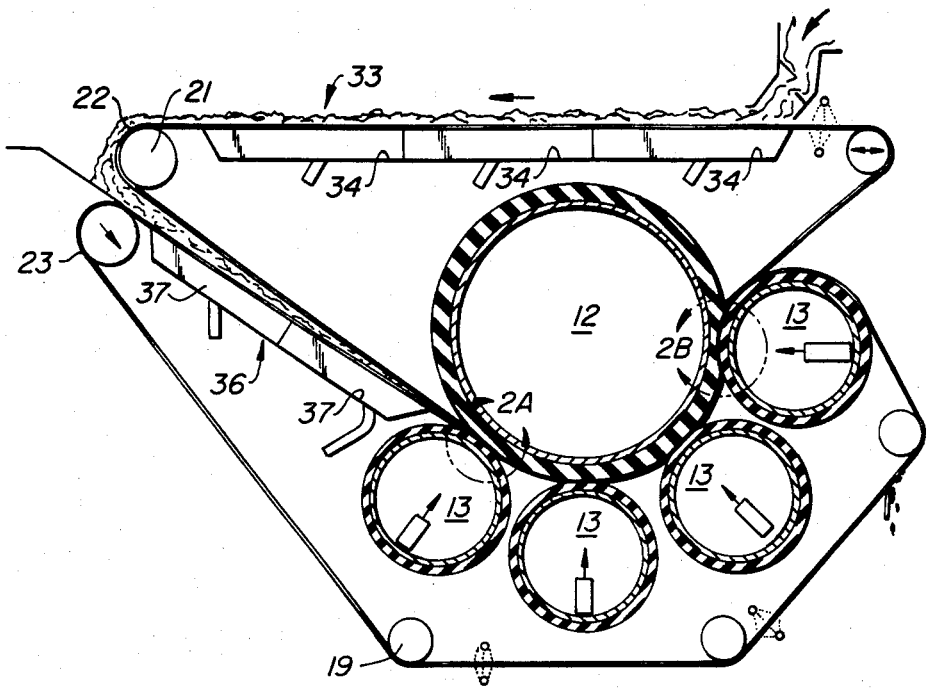
FIG. 2 is a diagrammatic side elevation depicting an embodiment of the invention adapted to accept a dilute slurry.
Figure 2B:
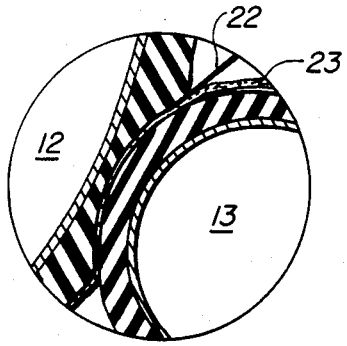
FIG. 2B is an enlarged view of the portion of FIG. 2 enclosed in circle 2B, the relative deformabilities of the layers on the downstream pressure roll and the primary roll being exaggerated for the sake of illustration.
Figure 2A:
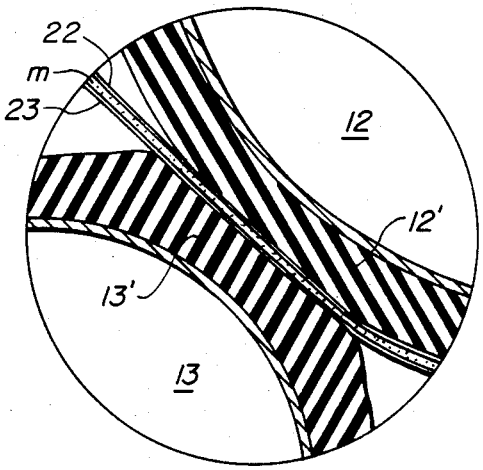
FIG. 2A is an enlarged view of the portion of FIG. 2 enclosed in the circle 2A illustrating the substantially deformable elastomeric layers on the upstream pressure roll and the primary roll.

As shown in FIG. 1, a prototype form of the expressing apparatus 10 comprises side frames 11 between which extend a plurality of rotatable rolls including a single primary or central roll 12 (partially visible in FIG. 1 and shown for instance in FIGS. 2A to 2B). A plurality of press or pressure rolls 13 are circumferentially spaced about the lower portion of the primary roll and are journalled for rotation in bearing blocks located in guides inside the plate 11 and which allow the roll shafts 14 to extend through slots 16 in the side plates.

The inside bearing blocks are mounted in guides that follow and are parallel to slots 16 which are oriented radially with respect to the shaft 17 forming the axis of the primary roll 12 whereby they may be pressed with selected force against the surface of the primary roll. The force for radial movement of the bearing blocks and press rolls is applied by any suitable means such as hydraulic rams 18 which connect by a collar 20 about each shaft 14.

Several idler rolls 21 are journalled in other suitable bearing blocks located on the side plates and are positioned to guide endless belts 22 and 23 through the unit. Inner belt 22 is guided to pass successively around and in contact with the surface of the primary roll 12 then over a series of idler rolls above the primary roll while the other or outer endless belt 23 is guided successively over the primary roll between it and the press rolls 13 then over a series of idlers 19 below the center line of the primary roll 12 and an idler adjacent the top of the unit. Thus, the two belts pass in face-to-face relationship through the successive pressure zones defined between the primary roll 12 and the several press rolls bearing thereagainst. Selected tension on the inner belt 22 is applied by the rams 18 on one or more of the upper idlers while selected tension on the outer belt 23 is applied by similar rams acting on an appropriate idler. The belts may be guided in their travel by any usual means such as by tilting idlers in known manner.

The primary roll is rotably driven by sprockets 24, chain 26 and motor 27 thus moving the belts and idlers as necessary. Feed is supplied to the unit at the inlet space 28 (FIG. 1) between belts; cake is discharged at a discharge point, indicated by arrow 29, after the belts separate, while expressate which is collected in suitable internal pans is discharged through a suitable conduit 31.

Feed is supplied at the inlet 28 by any means suitable to the material being handled. For instance, if the feed is filter cake a simple conveyor may be used to drop the cake into a feed hopper from which it falls or is forced into the space between the belts 22 and 23. Alternatively, if the feed is thick but pumpable, as is often the case with clays, the feed will be pumped into the entrance area 28 and is later spread by the pressure between belts and in the compression zones between the primary and the press rolls.

In a still further modification, shown in FIG. 2, the feed is supplied as a relatively dilute slurry onto an initial vacuum-assisted drainage section generally designated 33 which comprises a series of vacuum pans 34 connected to a suitable vaccum source of increasing intensity and arranged so that as the inner belt 22 passes over the pans, liquid from the slurry is drawn through the belt into the pan where it is withdrawn as filtrate. The resulting cake, which is still quite wet, travels onto a second vacuum section 36 where it is introduced between the two belts 22 and 23 then is carried over additional vacuum pans 37 whence filtrate is removed and carried away. Thereafter, the solids are carried through the successive high pressure compression stages in accordance with the invention.

The embodiments illustrated in FIGS. 1 and 2 both employ two belts comprising an inner belt 22 and an outer belt 23 between which the mixture is carried. For some material it is possible to employ only a single belt 22. In such a case the solids (mixture) are retained between the single belt and the primary roll 12 as the material is carried through the successive pressure zones.

Figure 4:
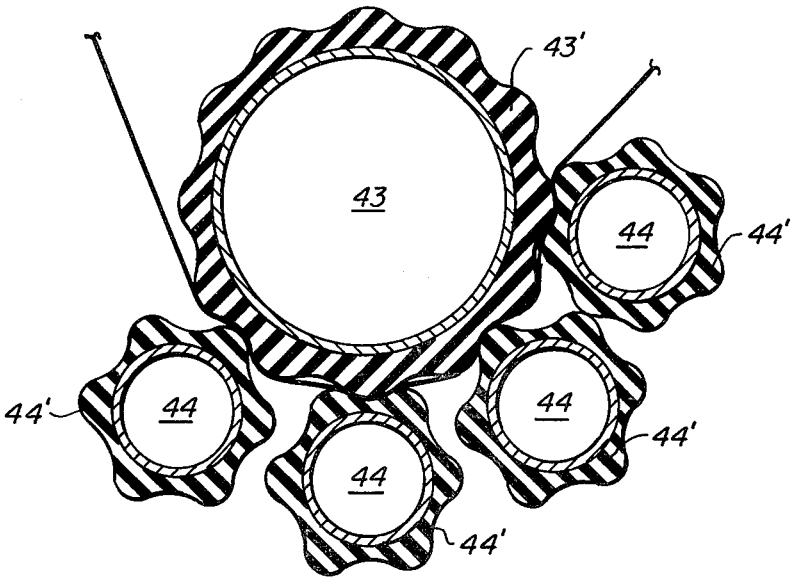
FIG. 4 is a diagrammatic section illustrating another embodiment of the invention in which the elastomeric roll surfaces are undulating or corrugated to enhance liquid expression while providing a positive solids retention.
Figure 8:
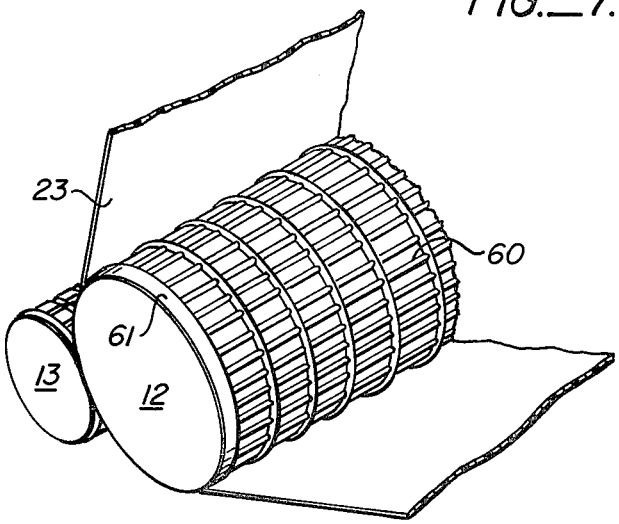
FIG. 8 is a diagrammatic perspective illustration of a belt and rolls with cake engaging rib elements formed in the elastomeric layers on the rolls to further facilitate capture and subsequent retention of solids in the compressed zones between rolls.

Some material is quite slippery and hard to keep in place between belts especially when any significant squeezing pressure is applied. To further assist in overcoming this, the invention contemplates modifications that provide a more positive grip. One form of this is illustrated in FIG. 4 in which the surface of a special primary roll 43 is corrugated or troughed longitudinally and the special press rolls 44 are shaped to match the corrugations. Another modification, illustrated in FIG. 8, incorporates a grid of small ribs, including longitudinal ribs 60 that are uniformly spaced about the circumferences on the primary roll and on some of the press rolls. Additionally, a circumferential ridge 61 is provided adjacent the ends of at least the primary roll.

Although the invention may be practiced with a variety of porous cloths for belts, I have discovered that a belt containing a fine filter medium ply along with one or more additional plies produces superior results.

Figure 5:
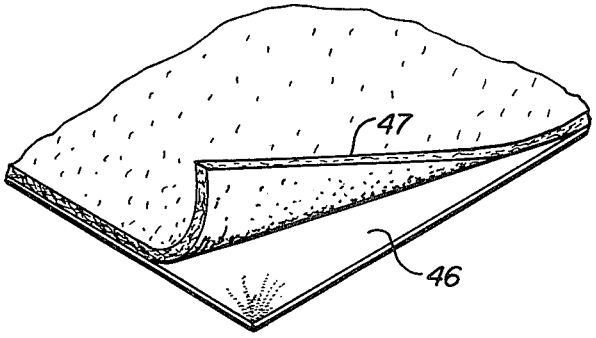
FIG. 5 is a view illustrating a two-ply filter belt useful in the invention.
Figure 6:
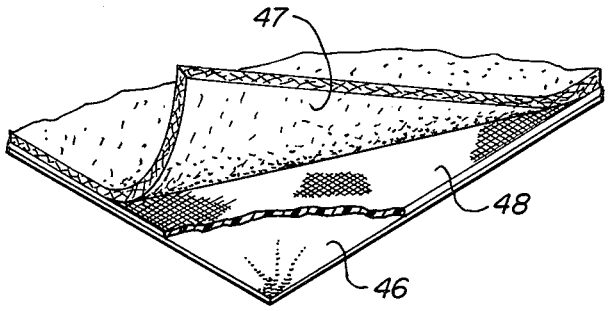
FIG. 6 is a view similar to FIG. 5, but illustrating a three-ply belt.
Figure 7:
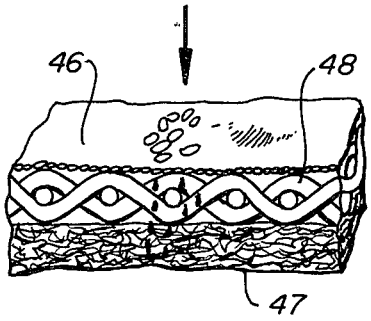
FIG. 7 is an enlarged fragmentary section of a three-ply belt.

FIG. 5 is a view showing construction of a two-ply belt comprising a filter medium layer 46 and a layer of absorbent felt 47. FIG. 6 is an illustration of a three-ply belt comprising a ply of filter material 46, a ply of relatively stiff monofilament material 48 and a ply of absorbent felt 47. FIG. 7, which is largely self-explanatory, illustrates in section the three-ply belt in FIG. 8, the belt being inverted to show a few solid particles on the filter medium layer. In the three-ply belt, the filter medium 46 and felt 47 may be the same as in the two ply belt. The monofilament ply 48 is provided for strength and/or stability of the belt in both directions and also serves as a filter deck to assist in drainage of expressed liquid. Obviously, the filter material 46 will always be selected to provide optimum solids retention for cake formation and expression with minimum blinding and will vary depending upon the solids (mixture) being treated. In all cases the fine medium 46 will be selected to filter the solids and it also will be chosen to radily release cake. The purpose of the felt layer 47 is to bear against and protect the roll surface and to absorb moisture; consequently, the belts are trained about the rolls with the absorbent felt ply 47 next to the roll surfaces. As the belts and solids are squeezed, the felt is compressed and its liquid content expressed. When the belts leave the compression zone, the absorbent layers expand to absorb free liquid thereby minimizing the reabsorption of liquid by the solids.

An important consideration is to gradually apply pressure in each stage in a predetermined manner that takes into account the wetness of the mixture and its tendency to be rejected from the nip. To achieve this, it is required that the wet mixture be gradually compacted and then pressed between rolls at a pressure that permits the rolls to accept and squeeze the mixture. If the pressure or squeezing force is too high, the solids will not be accepted in the nip between rolls but will pile up and be forced laterally from between the belts thus potentially causing a complete breakdown in operation. In the case of a two-belt system, as in FIG. 2, initial compaction of the solids is achieved by the converging belts which trap and carry the solids to the first pressure zone with the compactive force being applied by the outer belt. The pressure exerted by the upstream press roll is adjusted to deform the layers on the upstream pressure roll and the primary roll by controlled amounts so that they will readily accept the wet mixture. After passing through the first zone the pressure is significantly reduced in the intervals between the pressure rolls but the outer belt holds the mixture against the primary roll in its drier and more compacted state than when it entered the first nip zone; and this enables the more rapid application of force and also a higher peak force in the second zone. Therefore, the force exerted by the second press roll is increased to deform the elastomeric layers thereat to express further liquid phase, but still to subject the partially deliquified mixture to a controlled rate of increase in pressure dependent on the flow behavior of the drier mixture to assure that the mixture will be accepted in the nip without lateral rejection. Similar considerations are utilized in each succeeding stage until the several pressing operations are completed.

Figure 9:
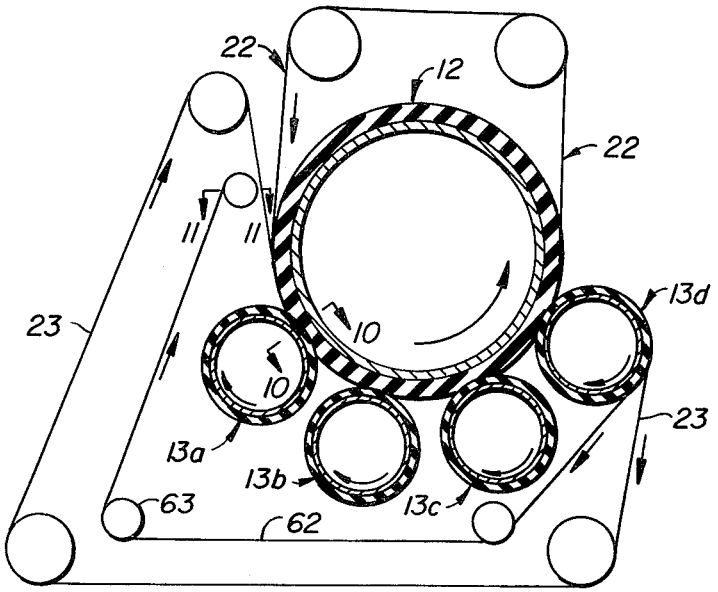
FIG. 9 is a diagrammatic view illustrating a system that uses separate loose straps for restraining the mixture against lateral escape from the pressure zones.
Figure 10:
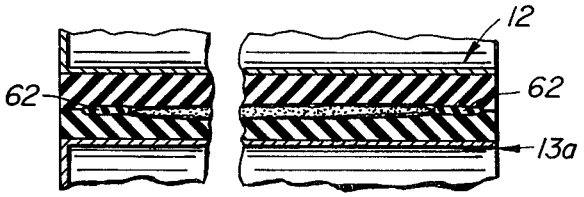
FIG. 10 is a sectional view taken generally in the direction of arrows 10—10 of FIG. 9.
Figure 11:
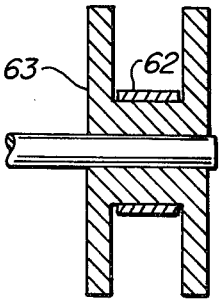
FIG. 11 is a sectional view taken generally in the direction of arrows 11—11 of FIG. 9.
Figure 10A:
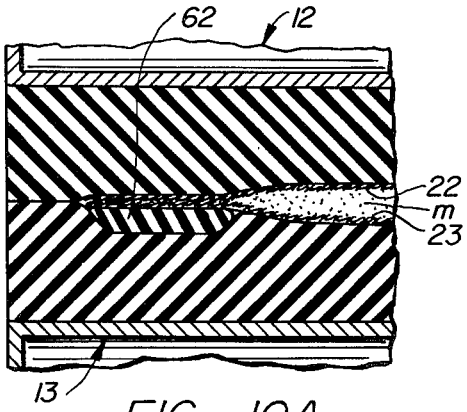
FIG. 10A is an enlarged section taken in the side margin area of the embodiment shown in FIGS. 9 and 10.

FIGS. 9–11 illustrate an embodiment wherein separate loose narrow straps or bands 62 are guided and tensioned adjacent the margins of the belts to seal the belt edges against lateral escape of the mixture. Each strap is kept under tension and guided by flanged pulleys 63 so that it is trained about the primary roll over the side margins of both belts 22 and 23 to hold them together against the primary roll to thus prevent lateral solids escape, as shown in FIG. 10A. A modification not shown, but within the scope of the invention is to sew the tape or strap to the edge of the outer surface of the outer belt 23; in such case, the strap may be a woven synthetic belt.

Figure 12:
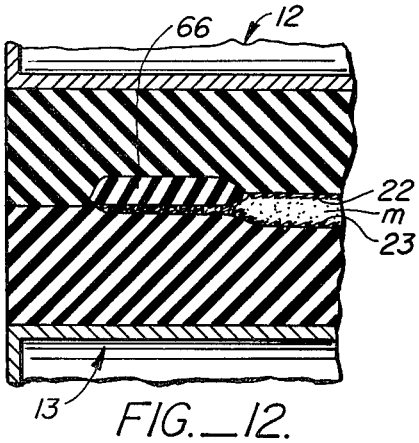
FIG. 12 is an enlarged sectional view similar to FIG. 10A but illustrating an alternate arrangement for restraining the mixture against lateral escape from the side margins of the belts.

FIG. 12 illustrates an embodiment in which the edge seals are accomplished by two elastomeric straps 66 that are respectively bonded to the elastomeric layer on the primary roll 12 near the side margins thereof. The straps are thicker than the anticipated thickness of the mixture as received and spread between the belts near the margins thereof. The elastomeric edge seal straps 66, in effect, provide a ridge of elastomeric material that presses the margins of the belts against each other with a greater pressure than exerted elsewhere on the belts. As in the other embodiments, such greater pressure is exerted over substantially wide zones at the sides of the belts, thus extending any potential leak path through which liquids or mixture must migrate to escape from between the belts.

In accordance with the invention, the compression or pressure zones (nips) have a finite width (in the direction of travel of the belts), thus forming so-called extended nips. Thus, rather than pass the mixture to be dewatered between two hard unyielding rolls by which pressure is applied along a thin line of contact, a deformable surface is provided on the primary roll and on one or more of the press rolls. This results in a relatively wider pressure zone—perhaps 1 to 4 inches wide across the roller face which due to the controlled rate of increase in pressure at the entrance of the nip, enhances capture of the mixture. Also, the total expressing force applied to the mixture is spread over a greater area, which is believed to enable greater liquid removal at high belt speeds. Typical peak expressing forces will normally vary depending on the material. They may, for example, be as low as 10 psi and as high as several hundred psi. To produce the same total pressure on the mixture with narrower (smaller area) zones of extended nip contact, the peak pressure may be higher, while with wider zones of relatively greater area, the peak pressure may be lower. If the durometer of the deformable surfaces or layers on the pressure rolls changes from roll to roll, while the layers are equally thick, the contact area will differ, hence the period of pressure application (residence time) will be longer, or shorter, but the total pressure may be equal. In some cases the lower peak pressure, with the extended application in the nip, is believed advantageous because it provides more time for the free water to be expressed from the solids. Another variable is press roll diameter. Smaller rolls will, at a constant total force, yield a higher pressure for a shorter time period.

Figure 3:
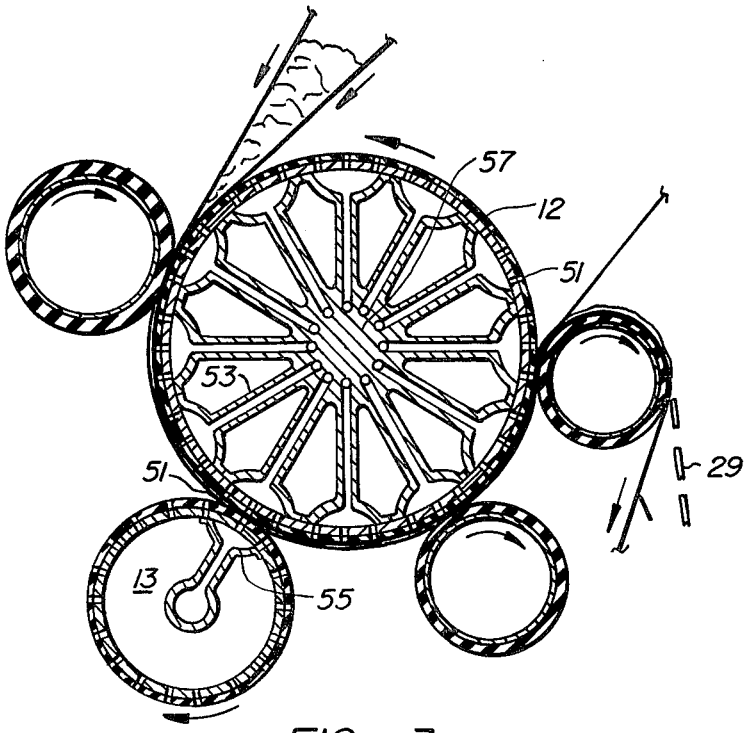
FIG. 3 is a sketch illustrating an embodiment of the invention in which the rolls used for expression are constructed to enable a pressure differential discharge of expressed liquid and/or controlled supply of wash through the mixture.

Water (or other liquid) expressed from the mixture is in most cases simply allowed to drop into catch basin such as an underdrain pan. In other cases, however, it is desirable to remove the liquid as rapidly as possible to prevent reabsorption by the mixture. In accordance with the invention this is accomplished by the provision of a hydraulic or liquid withdrawal system within the rolls as shown in the embodiment illustrated in FIG. 3. In this embodiment the primary roll 12 and a roll 13 are provided with perforated surfaces, more particularly perforated elastomeric coverings 51, which communicate through sectors 52 and conduits 53 to a vacuum source, not shown but which will be of conventional construction, which draws away water as it is forced through the perforations. The roll 13 comprises a fixed shoe 55 past which the inside roll surface passes and through which expressate may be withdrawn by the same vacuum source that is connected to the primary roll. The hydraulic system of the primary roll (as shown) is similar to a drum filter with the conduits 58 connected to a usual valve 57 which is well known.

In some cases it is desirable to wash the mixture between pressure stages. This may also be accomplished in the FIG. 3 embodiment simply by supplying wash liquid under pressure through a perforated roll 13 located between two of the pressure rolls 13 which rotates against the outer belt, while maintaining the primary roll in communication with the source of vacuum. In this manner, wash liquid is fed through the perforated wash roll and then passed through the compacted mixture and is carried away through the perforated primary roll. Washing can be also achieved by flooding the belts and mixture with water just ahead of their entrance into a nip, while withdrawing the water through the primary roll and then expressing remaining wash water out in the next pressure zone.

As in any method or apparatus involving fine solids and porous filter medium, the medium tends to become blinded by fine solids. This problem is compounded by the application of physical force as the belts pass between the rolls. However, according to the invention this problem is alleviated by the provision of wash boxes and complementary catch pans, all of which can be internally connected to the conduit 31 as indicated in 31 in FIG. 1.

Some materials have a tendency to stick to the belts in a two belt system or to the surface of the primary roll 12 in a single belt system thus causing blinding in the system. In accordance with another feature of the invention this problem is avoided by subjecting cake and belts and/or roll surfaces to a shearing action to effect release and discharge of the cake. The shearing action is accomplished circulating the outer belt 23 away from the inner belt 22 as the belts exit from the final nip and by forcing the belt (or belts) to change its path of travel as it passes through the final compression zone (nip). This may be done by covering the opposed rolls forming the final zone with elastomeric layers of significantly different durometers compared to other stages. Illustratively, in FIGS. 2 and 2B, the final pressure roll is covered with an elastomeric layer that is less deformable than the elastomeric layer on the primary roll. Alternatively, the final press roll may have no rubber (elastomeric) layer on its surface. As is clearly seen by comparing FIGS. 2A and 2B, the contour of the belt path in the last zone is markedly different. This makes it impossible to have a flat final zone like that of the next preceding zone in which both opposed rollers are equally deformable. Instead, in the final zone there is a sharp indent into the elastomeric surface of the softer primary roll and, in following the resulting altered path, the cake and belt undergo what is termed "shear" to effect cake release from the inner belt, the cake remaining on the outer belt which is circulated from the nip over the final pressure roll.

In order to operate in accordance with the present invention, the apparatus must be sturdy of construction and, for certain mixtures, will be capable of forcing the pressure rolls against the primary roll with sufficient force to generate squeezing pressure on the mixture as high as 1000 psi.

Figure 14A:
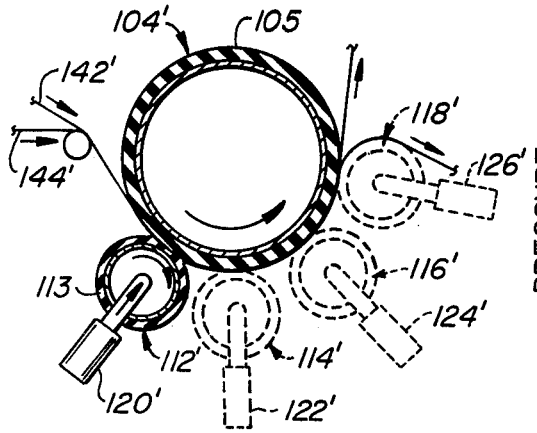
FIGS. 14A–14C diagrammatically illustrate a preferred embodiment wherein the elastomeric layers or coverings on the pressure rolls have equal thickness but different hardnesses.
Figure 15A:
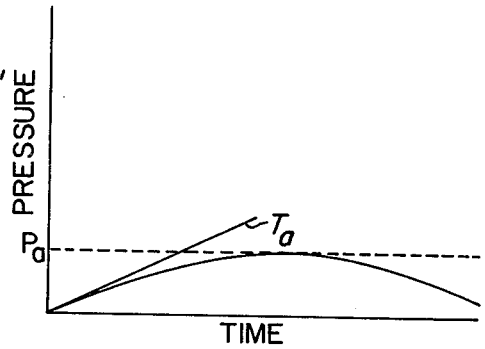
FIGS. 15A–15C show pressure-time profiles or curves for the successive pressure rolls illustrated in solid outline in FIGS. 14A to 14C, respectively.
Figure 14B:
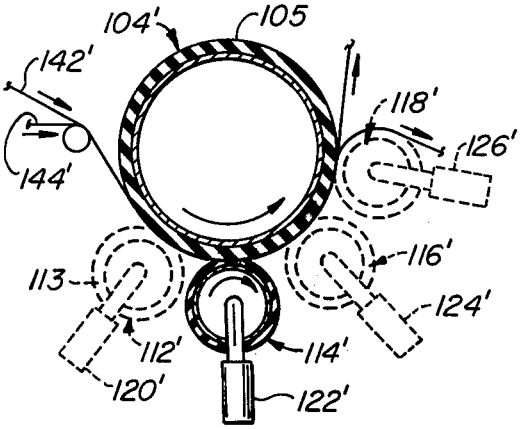
Figure 15B:
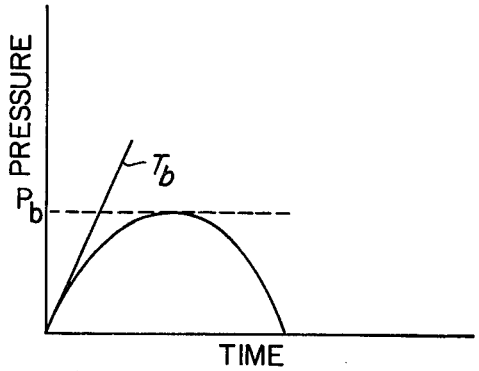
Figure 14C:
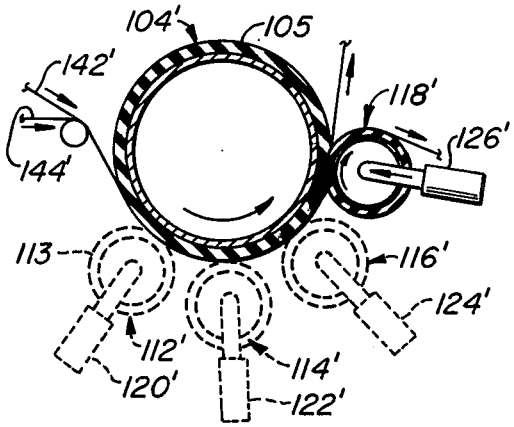
Figure 15C:
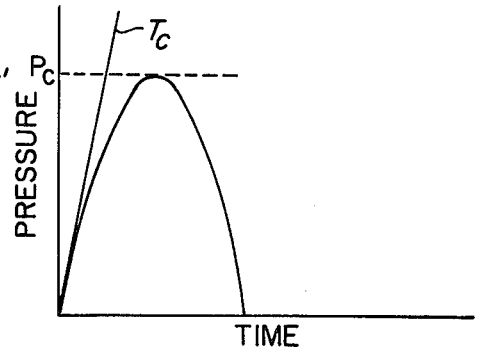

As previously noted, pressures in the successive pressure zones increase in the direction of belt travel and this generates a distinct pressure profile. Exemplary pressure profiles are depicted in FIGS. 15A–15C, which are plots of conditions in a total system of the type generally illustrated in FIGS. 14A–14C and described hereinafter.

From the foregoing it is apparent that the basic press comprises a primary roll and a plurality of press rolls bearing thereagainst, the primary roll and at least some of the press rolls having a surface layer of deformable rubber or other elastic (elastomeric) material. The press rolls are mounted to move toward and away from the surface of the primary roll; and hydraulic rams or equivalent adjustable means are provided to force the press rolls against the primary roll with preselected forces.

Tests were performed on a prototype similar to that illustrated in FIG. 1. The unit employed a 26 inch diameter primary roll and 12 inch diameter press rolls spaced about the lower part of the primary roll. All of the rolls were covered with a one inch layer of natural rubber of about 35 durometer hardness. The press rolls were journalled in sliding bearing blocks each of which was attached to a hydraulic ram for forcing the press roll against the primary roll.

In a test on kaolin clay two belts were employed. The inner belt was three-ply as illustrated in FIG. 6 and the outer belt was a two-ply belt as illustrated in FIG. 5. The three-ply belt included a fine filter medium layer of polyester cloth, a middle layer of monofilament polyester and a felt layer of polypropylene. The two-ply outer belt omitted the middle layer but had a narrow strap sewn along both edges overlying the felt to assist in sealing the belt edges as described in connection with FIGS. 9–11. The belts were trained about the primary roll with the fine filter medium layers face-to-face and the felt layers facing the appropriate roll surface. Appropriate idlers, tension adjustment and alignment rolls were provided.

The feed was previously filtered kaolin clay of 58 percent solids which was supplied to the space between the converging belts before their entry into the nip between the primary roll and the first press roll. Pressure on the first press roll 13 was at 25 psi, which allowed the solids (wet mixture) to be retained between belts. The pressure was increased in stages. The second roll exerted 50 psi. the third 100 psi and the final roll 200 psi. Between rolls the tensioned belt applies a pressure of about two psi. In this set-up pressure profiles generally similar to those shown in FIGS. 15A–15C, would have peaks pressures from a low of 50 psi to a high of 200 psi, but with intervening low pressures between rolls of only about two psi.

Under the above conditions, the initial feed containing 58 percent solids was further dewatered to a cake containing 72 percent solids. This represents a 46 percent removal of residual moisture. This is significant because the final product must be dry and removal by the press of this invention is much less expensive than removal by heat.

Samples of other materials processed in the same machine with different belts produced similar dramatic results. For instance, an increase in percent solids according to the following table was achieved in the press of this invention described in connection with the preceding example.

| MATERIAL | PRESS FEED PERCENT SOLIDS | DISCHARGE FROM PRESS PERCENT SOLIDS |
|---|---|---|
| Corn Gluten | 42% | 55% |
| Glucoamylase | 23% | 41% |

-continued

| MATERIAL | PRESS FEED PERCENT SOLIDS | DISCHARGE FROM PRESS PERCENT SOLIDS |
|---|---|---|
| Corn Fiber | 21% | 53% |

Figure 13:
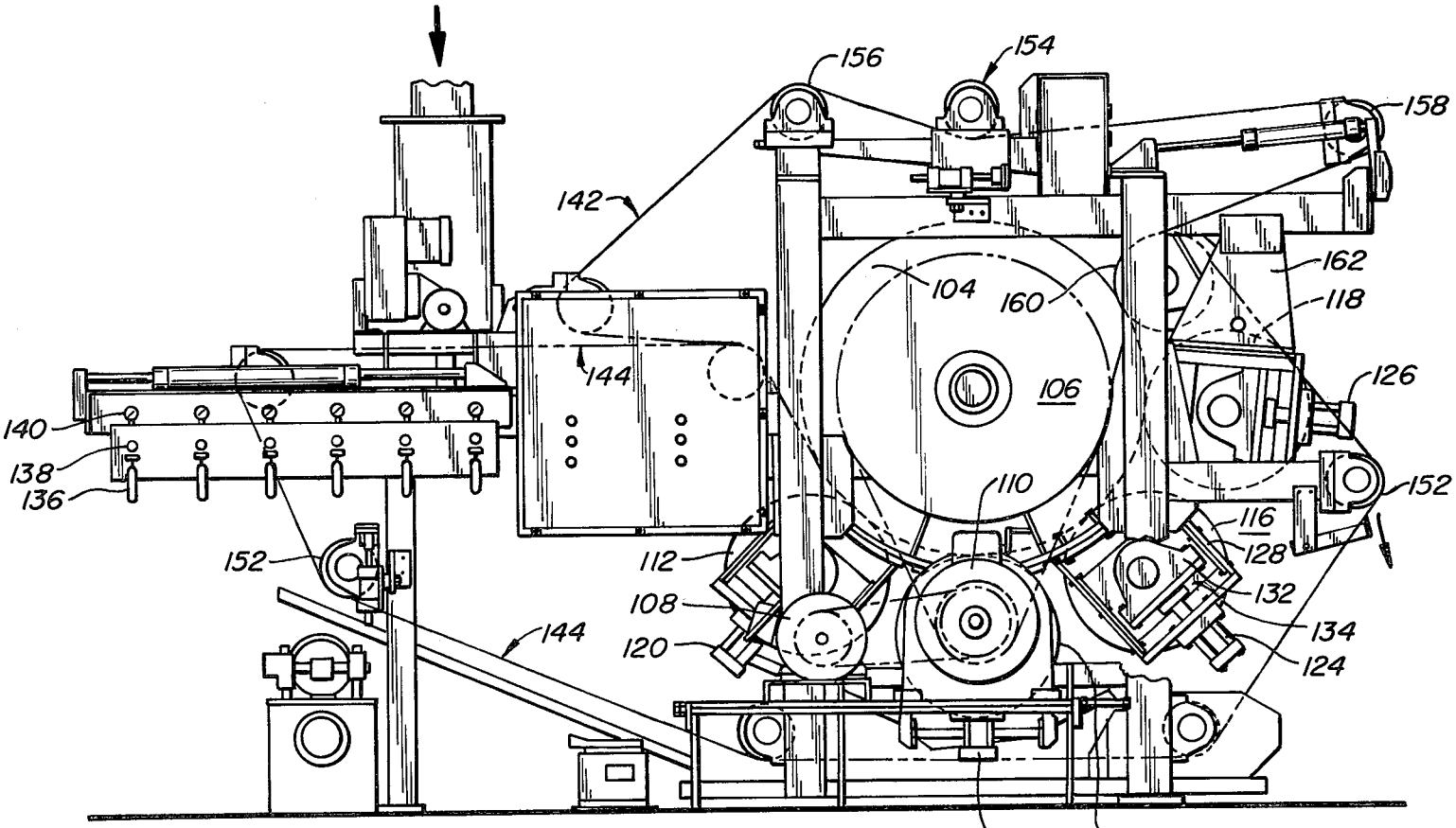
FIG. 13 is a side elevation of another preferred embodiment of the expressing apparatus of the present invention.

According to the embodiment shown in FIG. 13, an expressing apparatus 100 is provided for expressing the liquid phase from a wide range of wet mixtures. The apparatus 100 has been tested on a clay mixture having a gel-like flow behavior with an initial solids content of about 55 percent to 60 percent solids and was found to dewater the mixture to produce a cake-like mixture having a solids content of about 68 percent to 72 percent solids. The gel-like clay mixture contained colloidal sized particles that would make it very difficult, if not impossible, to permit the mixture to be admitted into the nip between conventional metal rolls, even if the rolls were of large enough diameter to provide a relatively small nip angle for facilitating capture of the mixture. The illustrated cake press directly handled such gel-like mixture without preconditioning, i.e., preliminary dewatering, of the type shown for example in FIG. 2. The illustrated apparatus 100 expressed moisture to the aforementioned solids content range at a throughput or production rate of about 2000 to 3000 lbs. of dry solids discharge per lineal meter of face.

Referring to FIG. 13, apparatus 100 includes a frame 102 comprised of tubular steel members. A primary roll 104 is horizontally mounted upon bearings (not visible in the drawing as the bearing on the illustrated side is obscured by the drive sprocket 106) and is driven by an electric motor 108 through a variable speed reducer 110. The primary roll is comprised of a cylindrical steel drum upon which a 1 inch thick layer of elastomeric material is bonded. The elastomeric material employed is a natural rubber having a durometer hardness of 35. The diameter of the drum is 48 inches.

Four elastomeric covered secondary or pressure rolls 112–118 are mounted to the frame 102 at circumferentially spaced positions generally about the lower half of the primary roll 104. Each pressure roll is of identical contruction, and the rolls 112–118 are adjustably and individually biased toward the primary roll by a separate pair of hydraulic cylinders 120–126, respectively. Each pressure roll is supported at both ends by an identical slide structure that enables it to reciprocate radially of the primary roll and to rotate about a horizontal axis that is, of course, parallel to the primary roll. One of such structures is illustrated in FIG. 13 with respect to the third of the four pressure rolls. It includes a slide bracket member 128 rigidly mounted to a heavy cylindrical flange that is concentric with the primary roll. Each pressure roll has stub shafts at its ends that are rotably received by pillow block bearings 132. These bearings are mounted to slide members which are, in turn, slidably received on the respective slide bracket members at opposite sides of the frame. The pistons of the cylinders operate on the slide plates to thus force the pressure roll against the primary roll with a selected generally constant pressure. The pairs of cylinders associated with respective pressure rolls are connected to separate hydraulic circuits. The separate controls for each circuit, shown diagrammatically adjacent the feed end of the press, each include a four-way valve 136 that enables each cylinder to be individually disengaged if desired, a pressure-regulating valve 138 and a pressure gauge 140.

Apparatus 100 further includes a pair of endless filter belts 142 and 144 for carrying the mixture to be dewatered successively through the nips between the primary roll 104 and pressure rolls 112–118. The belts are of identical construction including two plies, wherein the inner ply is fabricated from a paper-thin, fine mesh size, multifilament polyester belting and the outer ply is made from a larger mesh size, monofilament polyester belting. The two plies are sewn together at their side margins. The outer plies (adjacent the rolls) are sufficiently strong in their longitudinal dimensions to withstand substantial tension and in their lateral dimensions to provide lateral stability. The outer plies are sufficiently heavy and porous to permit free water expressed within the nips to escape in all directions—thus serving as a deck layer. The inner plies (adjacent the mixture) are relatively tight and smooth to facilitate cake release and have a mesh size fine enough to filter the expressate (liquid phase) that is expressed from the mixture within the nips.

FIG. 13 illustrates a suitable roll arrangement for circulating the endless belts 142 and 144 around the primary roll 104 and for tensioning the belts against the primary roll before they enter the first nip between upstream roll 112 and the primary roll. The arrangement for lower belt 144 includes a take-up roll 146 upstream of the feeder 148 and a roll 150 downstream of the feeder that is vertically aligned with roll 146 to form a horizontal feed zone. The latter roll is located above the axis of rotation of the primary roll and is sufficiently close to the primary roll so that the lower (outer) belt is entrained firmly over the inner belt to engage both belts against the primary roll well ahead the first nip associated with the upstream pressure roll. Take-up roll 146 is horizontally tensioned by suitable hydraulic cylinders to cause the lower belt tightly to sandwich the mixture and inner belt against the primary roll. The lower belt circulates out of contact with the primary roll over a roll 160 and therefrom over a series of rolls 152 through a return path under the pressure rolls to the take-up roll. The roll upstream of the take-up roll is part of a conventional web-aligning device.

Upper belt 142 is entrained upon a so-called Dandy roll located above the horizontal feed section of the lower belt upstream of roll 150. The upper belt thus converges from such roll into contact with the wet mixture in the vicinity of roll 150. The mixture is thus captured between the belts at such point and both belts circulate over roll 150 in a zone between the tensioned belts and then the belts come into firm contact against the primary roll before entering the nip of the upstream pressure roll. In this zone between roll 150 and the first nip, the wet mixture is distributed by the belt tension generally uniformly across the width of the belts.

Upper belt 142 is aligned with lower belt 144 by a conventional belt-aligning device 154 in conjunction with a bowed roll 156. A take-up roll 158 is located upstream of aligning device 154. The upper belt is held against primary roll 104 by the roll 160 located above the downstream pressure roll 118. The last-mentioned roll is rotatably mounted upon a pair of lever members that are pivotally connected to support brackets 162; the brackets in turn are connected to the slide bracket members for pressure roll 118. This arrangement keeps the upper belt firmly tensioned against the primary roll to facilitate release of the cake, i.e. the dewatered mixture, from the upper belt as the belts diverge after emerging from the last nip.

Although not shown in FIG. 13, edge seals are provided adjacent the margins of the belts 142 and 144 by the separate edge seal strips that are sewn to the side margins of both belts 142 and 144. These bands are made of woven monofilament polyester. Their function is to pinch the side margins of the belts against each other, as illustrated in FIGS. 9–12 and discussed herein.

The pressure rolls 112–118 of this embodiment each include a 1 inch thick layer of elastomeric material bonded to and covering the cylindrical surface of a steel drum having an outer diameter of 22 inches. Each pressure roll covering has a durometer hardness equal to that of the primary roll covering, that is, a durometer hardness of 35.

The biasing pressure applied against the pressure rolls 112–118 is greatest on the downstream roll 118. In particular, the hydraulic pressure of cylinder 126 is set to exert a peak pressure on the mixture of approximately 500 psi. The pressure applied to the preceding rolls is progressively less so that the peak pressure applied by cylinder 120 on the mixture in the nip of upstream roll 112 is on the order of 60 psi. The peak pressure on the mixture in the nips of the second pressure roll 114 is approximately 125 to 150 psi and in the third nip of roll 116 is on the order of 250 to 300 psi.

The pressure applied by cylinders 120 on the first or upstream roll 112 is sufficiently small to produce a relatively gradual rate increase in pressure immediately as the mixture enters the nip, thereby facilitating admission of the wet mixture into the upstream nip. Due to the substantial deformabilities of the thick 35 durometer layers on both the primary and the upstream pressure roll, this pressure increase is sufficiently gradual to permit ready admission of the aforementioned gel-like clay mixture into the nip and to thereafter progressively express a substantial volume of water from the mixture as the mixture enters deeper toward the center of the extended nip to a point where the pressure is maximum, i.e. where the pressure reaches its peak value of about 60 psi. It was observed that a substantial volume of free water was continuously expressed from the clay mixture so as to flow from the mixture in the vicinity of where it enters the first extended nip. As shall be discussed in connection with the next preferred embodiment, the hardness of the elastomeric material on the upstream pressure roll is chosen in view of the diameter of the pressure roll and its thickness to assure that the covering is so deformable that cause its pressure profile or curve has a relatively shallow slope at the start of the nip. Such slope or gradual increase in pressure (as indicated by the tangency lines in FIGS. 15A–15C) is important in assuring that the wet mixture, particularly if it has the gel-like flow behavior, as is the case with the clay material mentioned hereinbefore, will be admitted into the upstream nip.

The substantial deformability of the elastomer forming the coverings on the primary roll 104 and pressure rolls 112–118 is also important in assuring that the seals formed by the seal strips at the margins of the belts 142 and 144 will prevent mixture from being squeezed outwardly from the side margins of the belts. In particular, the elastomeric layers on both the opposed coacting primary and pressure rolls will deform about the obstruction provided by the respective sealing strips so that relatively greater pressure will be applied against the contiguous side margins of the opposed belts to pinch wide marginal areas thereof against each other. This enhanced pressure is sufficient in view of its width to prevent the mixture from leaking through the side margins.

FIGS. 14A–14C and 15A–15C illustrate yet a further embodiment wherein the elasticities or deformabilities of the layers formed on the various pressures rolls 112'–114' are different. In this embodiment, the upstream pressure roll 112' has a layer 113 of elastomeric material which is relatively soft; for example, it may be a neoprene elastomer having a durometer hardness of approximately 10 and be approximately 1 inch thick and have an outer diameter of approximately 24 inches. The next pressure roll 114' (FIG. 14B) downstream therefrom may have layer 115 thereon of a hardness of approximately 35 durometer, its thickness and outer diameter being the same as for the upstream roll 112'. The elastomeric layer on next pressure roll 116', in the path of travel of the belts 142' and 144', shown only in phantom outline, may have the same deformability characteristic as the second roll 114'. The downstream roll 118' (FIG. 14C) may have an elastomeric covering of a hardness of approximately 55 durometer, its outer diameter and thickness being identical to the other pressure rolls. Thus, the downstream roll is covered with a layer which is harder (i.e., less deformable) than covering 105 on the primary roll.

In this embodiment, the primary roll 104' would preferably have a 1 inch thick elastomeric covering 105 having a durometer hardness of about 35, its total outer diameter being approximately 48 inches. Thus, layer 113 bonded to upstream roll 112' is relatively highly deformable, and the layers bonded to the subsequent rolls 114'–118' in the path of travel of the belts 142', 144' increase in hardness (that is each successive layer is relatively less deformable under pressure).

The progressive increase in firmness of the elastomeric layers on the pressure rolls 112'–118' takes into account the increasing solids content of the mixture acted upon by these rolls. The upstream roll 112' has such a highly deformable surface thereon that the mixture is subjected to a very gradual increase in pressure as it first enters the nip thereat. The initial rate of increase in pressure exerted on the mixture as it enters the nip is indicated by the tangent line $T_a$ in FIG. 15A, such line being tangent to the pressure profile curve therein at the ordinate of the curve to indicate the slope of the curve at such point. The maximum pressure $P_a$ is of course proportional to both the generally constant, predetermined biasing pressure applied by the pair of hydraulic cylnders 120' acting thereon (shown diagramatically in FIG. 14A) and to the deformability of the elastomeric layers 113 and 105 on the pressure roll and the primary roll. It will be noted that as the biasing pressure is increased, the elastomeric layers will be further compressed; thus, the slope of the illustrated curve at the entrance to the nip will become steeper due to the relative decrease in deformability of the material caused by its deflection. Generally, the thickness of elastomeric layer 113 on the upstream pressure roll may, if desired due to the particular flow behavior of the wet mixture be further increased or such layer may be made from a softer elastomer to enhance its deformability, thereby reducing the slope of the pressure profile at the entrance to the upstream nip.

FIGS. 15B and 15C respectively illustrate the pressure profile curves for the relatively harder elastomeric layers on the pressure rolls 114'–118' that are downstream of the first roll 112'. The mixture, having been partially dewatered to a substantial degree as it progressed through the upstream nip, will have a higher solids content and thus will have a flow behavior that enables it to be admitted into a nip wherein the pressure initially exerted on the mixture increases at a more rapid rate. Taking the progressive dryness of the mixture into account, the initial slope of the curve in FIG. 15B for the 35 durometer hardness roll 114' is relatively steep compared to that associated with the upstream roll, as shown in FIG. 15A. It is also noted that progressively greater, generally constant biasing pressures are applied by the pairs of cylinders 122' and 126' on the rolls 114' and 118'. As the mixture progresses through the nip associated with the second roll 114', it will therefore be immediately subjected to a steeper rate of pressure increase and then to a higher maximum pressure, which maximum pressure corresponds not only to the increased pressure applied by the associated pair of hydraulic cylinders 122', (FIG. 14A), but also to the increased hardness of the elastomeric layer on the roll. It will also be noted that the residence times of the mixture in the second and third nips are reduced due to the reduced contact area between the primary roll and the associated pressure roll.

Downstream roll 118' has an elastomeric layer thereon which is less deformable than the covering 105 on primary roll 104'. As stated earlier, this difference is provided by forming the 1 in. thick covering on the last pressure roll of a substantially harder elastomer. As explained in connection with FIG. 2B, upon emerging from the last nip, the cake will tend to cling to the inner ply of lower belt 144' due to the shearing action exerted between the inner ply of the upper belt 142' and the cake. So, not only does the increased hardness of the downstream roll, together with the greater biasing force thereon, tend to drive even further liquid from the already substantially dewatered mixture in comparison to the expression forces applied in the preceding nip; but by virtue of pressing the belts into the softer primary roll covering, its hardness facilitates release of cake from the upper belt.

Although the best mode contemplated for carrying out the present invention has been herein shown and described, it will be apparent that modification and variation may be made without departing from what is regarded to be the subject matter of the invention.

I claim:

1. An apparatus for expressing the liquid phase from a wet mixture comprising: a frame, a cylindrical primary roll rotatably mounted to said frame, a plurality of cylindrical pressure rolls, means for rotatably mounting the pressure rolls to the frame such that said pressure rolls are parallel to said primary roll and mounted for rotation adjacent the primary roll in circumferentially spaced relationship about said primary roll, separate means for individually pressing each of said pressure rolls against said primary roll, an endless filter belt, means for circulating the belt around part of said primary roll to convey the wet mixture successively into the nips between said primary roll and each of said pressure rolls, and said primary roll and at least the upstream one of said pressure rolls each having a layer of elastomeric material on its outer surface adapted to substantially deform under pressure, and the means for individually pressing the upstream pressure roll against the primary roll exerting a preselected biasing force to subject the wet mixture to a relatively gradual rate of increase in pressure.

2. The expressing apparatus according to claim 1, wherein the means for pressing the upstream pressure roll toward the primary roll comprises a first pair of hydraulic cylinders acting at opposite ends of the pressure roll, and first adjustable pressure regulating means for supplying hydraulic fluid to the cylinders at a selected constant level so that the biasing force applied on the upstream roll is maintained at a predetermined, generally constant level.

3. The expressing apparatus according to claim 1, wherein the second pressure roll that is adjacent and downstream of said upstream pressure roll is also covered with a layer of elastomeric material adapted to substantially deform under pressure, and the means for individually pressing the second pressure roll is adapted to press the second roll with a biasing force that is greater than the force applied against the upstream roll, the elastomeric layer on the second roll being no less deformable than the layer on the upstream roll, whereby the partially deliquified mixture is subjected to a relatively steeper rate of increase in pressure as it is carried into the nip between the second roll and the primary roll.

4. The expressing apparatus according to claim 3, wherein the means for pressing the second pressure roll against the primary roll includes a second pair of hydraulic cylinders acting on the ends of the second pressure roll, and second pressure regulating means for supplying hydraulic fluid to the second pair of cylinders at a predetermined, generally constant level that is greater than said predetermined level of the first pressure regulating means to thereby apply a biasing pressure on the second pressure roll that is greater than that applied on the upstream pressure roll.

5. The expressing apparatus according to claim 1, wherein an elastomeric layer is formed on the second pressure roll that is adjacent and downstream of said upstream pressure roll, said layer on the second roll being less deformable than the elastomeric layer on the first pressure roll.

6. The expressing apparatus according to claim 5, wherein the elastomeric layers on the upstream and second pressure rolls are of equal thickness, and the elastomeric layer on the second roll is harder than the layer on the first roll.

7. The expressing apparatus according to claim 1, wherein the last downstream pressure roll has an elastomeric layer thereon that is substantially less deformable than the elastomeric layer on the primary roll, and further comprising means for circulating the belt out of the nip between the primary roll and the last downstream pressure roll around part of the downstream pressure roll, whereby said difference in hardness of the layers on the primary and downstream pressure roll facilitates retention of the dewatered mixture upon the belt.

8. The expressing apparatus according to claim 1, wherein those pressure rolls that are downstream of said upstream pressure roll and that have elastomeric layers thereon each have elastomeric layers that are less deformable that the elastomeric layer on the upstream pressure roll to thereby facilitate subjecting the partially deliquified mixture to relatively steeper increases in pressure in comparison to said relatively gradual rate of increase in pressure first exerted on the mixture as it is carried into the nip between the primary roll and the upstream pressure roll.

9. The expressing apparatus according to claim 8, wherein the elastomeric layers on the upstream roll and on said downstream rolls are of equal thickness, and the elastomeric layers on said downstream pressure rolls are harder than the elastomeric layer on the upstream roll.

10. The expressing apparatus according to claim 9 wherein the elastomeric layers on at least two of said downstream rolls are of different hardnesses with the harder one of said at least two rolls being located downstream of the other.

11. The expressing apparatus according to claim 1, wherein all of said pressure rolls have elastomeric layers thereon, the layers on at least two of the pressure rolls that are downstream of said upstream roll having different elastic deformabilities and the less deformable one of said two being downstream of the other so that the mixture is successively subjected to progressively steeper rates of increase in pressure in the direction of travel of the belt.

12. The expressing apparatus according to claim 1 with the addition of a second endless belt in face-to-face relationship with said first belt and traveling therewith, and means for introducing wet mixture between said belts prior to entrance of said belts into the nip between said primary roll and the upstream pressure roll.

13. The expressing apparatus according to claim 12 in which each of said belts comprises at least two plies including a first filter medium ply adapted to retain solids during expression of liquid, said first ply having a relatively close mesh size to facilitate release of dewatered mixture therefrom, said first ply facing the wet mixture, and a second ply facing the respective surface of the primary roll or the pressure rolls, the second ply being relatively porous, coarse and stiff to provide lateral and longitudinal strength to the belt while enhancing drainage of liquid expressed through the first ply.

14. The expressing apparatus according to claim 13, wherein said first ply of each belt is comprised of a monofilament media, and wherein the second ply is comprised of a multifilament media.

15. The expressing apparatus according to claim 13 wherein at least one of said two belts includes a third ply consisting of a relatively thick absorbent felt.

16. The expressing apparatus according to claim 1, wherein all of the pressure rolls are provided with layers of elastomeric material on their outer surfaces adapted to substantially deform under pressure, and said apparatus further including a second endless belt, means for circulating the second belt about part of the primary roll and through a zone that is upstream of the nip associated with the upstream pressure roll for receiving wet mixture between the belts, and means for pinching the side margin of the belts against each other to restrain lateral escape of solids from the respective compression zones between said primary roll and said pressure rolls.

17. The expressing apparatus according to claim 16, wherein said pinching means comprises an elastomeric strap bonded to the said primary roll adjacent each side margin thereof to register with the respective side margin of the belts.

18. The expressing apparatus according to claim 17, wherein each strap has a thickness at least as thick as the wet mixture as received and spread between the belts.

19. The expressing apparatus according to claim 16, which said pinching means comprises a strap entrained about said primary roll adjacent each side margin thereof with said belts being interposed between said strap and said primary roll, and means for applying tension to said straps to bias the straps toward the primary roll.

20. The expressing apparatus according to claim 19, wherein said means for circulating the first-mentioned belt and said means for circulating the second belt are arranged to engage both belts firmly against each other and against the primary roll within said zone that is upstream of the nip between the upstream pressure roll and the primary roll, said means for tensioning the straps being adapted to hold the straps against the first-mentioned belt within said zone.

21. The expressing apparatus according to claim 20, in which said straps are guided by pulleys onto said primary roll and away from said roll.

22. The expressing apparatus according to claim 16, in which said pinching means comprises endless straps respectively sewn to the side margins of at least said first-mentioned belt.

23. The expressing apparatus according to claim 1, wherein the elastomeric layer on said primary roll is perforated, said primary roll including conduit means communicating with the interior of the perforated elastomeric layer, liquid withdrawal means, valve means for connecting said conduit means to said liquid withdrawal means, to thereby withdraw liquid expressed within the nips inwardly through the perforated elastomeric layer on the primary roll.

24. The expressing apparatus according to claim 23, further comprising perforated roll means interposed circumferentially between two of the pressure rolls and biased toward the primary roll to rotate against the endless belt, and means for supplying wash liquid to said perforated roll means to thereby cause the wash liquid to flow through the belt and the mixture thereon and to be withdrawn through the perforated layer on the primary roll.

25. The expressing apparatus according to claim 1, wherein ribs are formed longitudinally at circumferential spacings on the surface of said elastomeric layer on the primary roll and at least some of said pressure rolls.

26. The expressing apparatus according to claim 1, wherein all of said pressure rolls are covered with elastomeric layers, and relatively deep corrugations are formed longitudinally at regular intervals in the layers on said primary roll and said pressure rolls, said corrugations on said pressure rolls being configured to mesh with corrugations on said primary roll as said rolls rotate.

27. An improved apparatus for expressing the liquid phase from a wet mixture including at least one endless filter belt adapted to receive the wet mixture, a plurality of pressure rolls, opposed roll means for forming together with the pressure rolls a series of nips that are spaced apart in the direction of travel of the belt, means for circulating the belt through said nips, and means for biasing said roll means and the pressure rolls against each other so that the liquid phase is expressed from the mixture as the mixture is carried on the belt successively through said nips, wherein the improvement comprises: at least two of the pressure rolls being covered with elastomeric layers of substantial deformability, including the upstream one of the plurality of pressure rolls that initially acts on the wet mixture, first means for applying a biasing pressure against the upstream pressure roll at a predetermined level that is preselected to subject the mixture to a relatively gradual rate of increase in pressure as the wet mixture is carried into the first nip, and second means for applying a biasing pressure on the other of said at least two pressure rolls at a relatively higher pressure to subject the mixture to a comparatively steeper rate of increase in pressure to thereby express further liquid phase from mixture already partially deliquified in said first nip.

28. The improved expressing apparatus according to claim 1, wherein said first means for applying biasing pressure on the upstream pressure roll comprises a first pair of hydraulic cylinders acting at opposite ends of the pressure roll, and first adjustable pressure regulating means for supplying hydraulic fluid to the cylinders at a selected constant level so that the biasing force applied on the upstream roll is maintained at a predetermined, generally constant level.

29. The improved expressing apparatus according to claim 27, wherein said second means for applying a biasing force on the second pressure roll is adapted to press the second roll with a biasing force that is greater than the force applied against the upstream roll, the elastomeric layer on the second roll being no less deformable than the layer on the upstream roll.

30. The improved expressing apparatus according to claim 29, wherein said second means for applying a biasing force on said second pressure roll includes a second pair of hydraulic cylinders acting on the ends of the second pressure roll, and second pressure regulating means for supplying hydraulic fluid to the second pair of cylinders at a predetermined, generally constant level that is greater than said predetermined level of the first pressure regulating means.

31. The improved expressing apparatus according to claim 27, wherein the elastomeric layer that is formed on the second pressure roll is less deformable than the elastomeric layer on the upstream pressure roll.

32. The improved expressing apparatus according to claim 31, wherein the elastomeric layers on the upstream and second pressure rolls are of equal thickness, and the elastomeric layer on the second roll is harder than the layer on the first roll.

33. The improved expressing apparatus according to claim 27, wherein said opposed roll means comprises a single roll that is covered with an elastomeric layer adapted to substantially deform under pressure, the last downstream pressure roll of the plurality of pressure rolls has an elastomeric layer thereon that is substantially less deformable than the elastomeric layer on said single roll, and further comprising means for circulating the belt out of the nip between the single roll and the last downstream pressure roll around part of the downstream pressure roll, whereby said difference in hardness of the layers on the primary and downstream pressure roll facilitates retention of the dewatered mixture upon the belt.

34. The improved expressing apparatus according to claim 27, wherein those pressure rolls that are downstream of said upstream pressure roll and that have elastomeric layers thereon each have elastomeric layers that are less deformable than the elastomeric layer on the upstream pressure roll to thereby facilitate subjecting the partially deliquified mixture to relatively steeper rates of increase in pressure in comparison to said relatively gradual increase in pressure first exerted on the mixture as it is carried into the first nip associated with the upstream pressure roll.

35. The improved expressing apparatus according to claim 34, wherein the elastomeric layers on the upstream roll and on said downstream rolls are of equal thickness, and the elastomeric layers on said downstream pressure rolls are harder than the elastomeric layer on the upstream roll.

36. The improved expressing apparatus according to claim 35, wherein the elastomeric layers on at least two of said downstream rolls are of different hardnesses, and the harder one of said at least two rolls is located downstream of the other.

37. The improved expressing apparatus according to claim 27, wherein all of said pressure rolls have elastomeric layers thereon, the layers of at least two of the pressure rolls that are downstream of said upstream roll having different elastic deformabilities and the less deformable one of said two being downstream of the other so that the mixture is successively subjected to a progressively steeper rates of increase in pressure in the direction of travel of the belt.

38. The improved expressing apparatus according to claim 27, with the addition of a second endless belt in face-to-face relationship with said first belt and traveling therewith, and means for introducing wet mixture between said belts prior to entrance of said belts into the nip between said upstream pressure roll and the opposed roll means.

39. The improved expressing apparatus according to claim 38 in which each of said belts comprises at least twio plies including a first filter medium ply adapted to retain solids during expression of liquid, said first ply having a relatively close mesh size to facilitate release of dewatered mixture therefrom, said first ply facing the wet mixture, and a second ply facing the respective surface of the opposed roll means or the pressure rolls, the second ply being relatively stiff to provide lateral and longitudinal strength to the belt and relatively porous to enhance drainage of liquid expressed through the first ply.

40. The improved expressing apparatus according to claim 39, wherein said first ply of each belt is comprised of a monofilament media, and wherein the second ply is comprised of a multifilament media.

41. The improved expressing apparatus according to claim 39, wherein at least one of said two belts includes a third ply, the third ply consisting of a relatively thick absorbent felt.

42. The improved expressing apparatus according to claim 27, wherein all of the pressure rolls are covered with layers of elastomeric material each adapted to substantially deform under pressure, and said apparatus further including a second endless belt, means for circulating the second belt with the first-mentioned belt through the nips between the opposed roll means and the pressure rolls through a zone that is upstream of the nip associated with the upstream pressure roll, and means for pinching the side margins of the belts against each other to restrain lateral escape of mixture from the respective nips.

43. The improved expressing apparatus according to claim 42, wherein said opposed roll means comprises a single roll, and said pinching means comprises an elastomeric strap bonded to the said single roll adjacent each side margin thereof to register with the respective side margins of the belts.

44. The improved expressing apparatus according to claim 43, wherein each strap has a thickness at least as thick as the wet mixture as received and spread between the belts in said zone.

45. The improved expressing apparatus according to claim 42, wherein said opposed roll means comprises a single roll, and said pinching means comprises straps respectively entrained about said single roll adjacent each side margin thereof with said belts being interposed between said strap and said single roll, and means for applying tension to said straps to bias the straps toward said single roll.

46. The improved expressing apparatus according to claim 45, wherein said means for circulating the first-mentioned belt and said means for circulating the second belt are arranged to engage both belts firmly against each other and against the single roll within said zone that is upstream of the nip between the upstream pressure roll and the primary roll, said means for tensioning the straps being adapted to hold the straps against the side margins of the first-mentioned belt within said zone.

47. The improved expressing apparatus according to claim 46, in which said straps are guided by pulleys onto said single roll and away from said single roll.

48. The improved expressing apparatus according to claim 42, wherein said opposed roll means comprises a single roll, and said pinching means comprises endless straps sewn to the side margins of said first-mentioned belt.

49. The improved expressing apparatus according to claim 27, wherein said opposed roll means comprises a single roll that has an elastomeric layer thereon which is perforated, said single roll including conduit means communicating with the interior of the perforated elastomeric layer, liquid withdrawal means, valve means for connecting said conduit means to said liquid withdrawal means to thereby withdraw liquid expressed within the nips inwardly through the perforated elastomeric layer on the single roll.

50. The improved expressing apparatus according to claim 49, further comprising perforated roll means interposed circumferentially between two of the pressure rolls and biased toward the single roll to rotate against the endless belt, and means for supplying wash liquid to said perforated roll means to thereby cause the wash liquid to flow through the belt and the mixture thereon and to be withdrawn through the perforated layer in the single roll.

51. The improved expressing apparatus according to claim 27, wherein said opposed roll means comprises a single roll having an elastomeric layer thereon, and ribs are formed longitudinally at circumferential spacings on the surface of said layer on the single roll and on the surfaces of the elastomeric layers on said pressure rolls.

52. Apparatus for separating the liquid phase from a dilute slurry comprising: a frame, a first drainage section mounted to the frame having a plurality of vacuum pans each connectable to vacuum source means, a second drainage section mounted to the frame including a plurality of vacuum pans each connectable to vacuum source means, a primary roll mounted to the frame for rotation about a horizontal axis, a plurality of pressure rolls that are rotatably mounted to the frame parallel to said primary roll, that are spaced relative to each other and that are pressed against said primary roll, said primary roll and at least the upstream one of said pressure rolls being covered by a layer of substantially deformable elastomeric material, separate means for independently forcing said pressure rolls against said primary roll at selected pressures, a first endless filter belt trained to pass over said first drainage section in communication with the vacuum transmitted through the pans therein and thereafter around a portion of said primary roll and through the nips between it and said pressure rolls, a second endless filter belt trained to pass over said second drainage section in communication with the vacuum transmitted through the vacuum pans therein and thereafter about said primary roll in face-to-face relationship with said first filter belt and to thereafter pass therewith between said primary roll and said pressure rolls, and means for supplying the dilute slurry onto said first belt.

53. Apparatus for expressing residual liquid from moist solids comprising a frame, a primary roll journalled for rotation on said frame, at least two press rolls mounted for rotation parallel to said primary roll and spaced successively thereabout, means for urging each of said press rolls independently against said primary roll to define successive compression zones, drive means for effecting rotation of said rolls, a first endless flexible fabric filter medium belt maintained under tension and trained about said primary roll between it and said press rolls to pass through said compression zones; the surfaces of said primary roll and at least one of said press rolls being deformable and of substantially equal deformability and the surface of one other of said press rolls is of deformability that is significantly different from that of said surface of said primary roll.

54. Apparatus according to claim 53 with the addition of a second endless filter medium belt in face-to-face relationship with said first belt and traveling therewith, and means to introduce moist solids between said belts prior to entrance of said belts between said primary roll and the first of said press rolls.

55. Apparatus according to claim 54 in which at least one of said belts comprises at least two plies including a filter medium ply adapted to retain solids during expression of liquid and to release said solids after expression of liquid therefrom, said filter medium ply facing the moist solids, and a ply of absorbent felt facing the surface of the primary roll or the press rolls.

56. Apparatus according to claim 55 with the addition to at least one of said belts of a third ply between said filter medium and said felt, said third ply being relatively coarse and stiff thereby to provide stability to said belt while enhancing drainage of liquid expressed from said solids.

57. Apparatus according to claim 53 with the addition of sealing means pinching the edges of the belts against said primary roll to restrain lateral escape of solids from the compression zones between said primary roll and said press rolls.

58. Apparatus according to claim 57 in which said sealing means comprises a circumferential groove adjacent each end of at least one of said primary roll and said press rolls.

59. Apparatus according to claim 57 in which said sealing means comprises a circumferential rib adjacent each end of at least one of said primary roll and said press rolls.

60. Apparatus according to claim 57 in which said sealing means comprises a narrow strap trained about said primary roll adjacent each end thereof with said belt being interposed between said strap and said primary roll, and means for applying tension to said strap.

61. Apparatus according to claim 60 in which said strap is sewn to said belt.

62. Apparatus according to claim 60 in which said strap is independent of said belt and is guided by pulleys onto said primary roll and away from said roll.

63. Apparatus according to claim 53 in which the last in succession of said press rolls has a surface of deformability significantly different from the surface of said primary roll.

* * * * *